US008339247B2

(12) United States Patent
Adamson et al.

(10) Patent No.: US 8,339,247 B2
(45) Date of Patent: Dec. 25, 2012

(54) LIGHTING CONTROL

(75) Inventors: Tony Adamson, Eindhoven (NL); Bozena Erdmann, Eindhoven (NL); Wolfgang Otto Budde, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 535 days.

(21) Appl. No.: 12/441,108

(22) PCT Filed: Aug. 29, 2007

(86) PCT No.: PCT/IB2007/053468

§ 371 (c)(1),
(2), (4) Date: Oct. 28, 2009

(87) PCT Pub. No.: WO2008/029323

PCT Pub. Date: Mar. 13, 2008

(65) Prior Publication Data

US 2010/0213876 A1 Aug. 26, 2010

(30) Foreign Application Priority Data

Sep. 6, 2006 (EP) ..... 06120200

(51) Int. Cl.
*G08B 13/14* (2006.01)
*G08C 19/16* (2006.01)

(52) U.S. Cl. ..... 340/13.26; 340/572.1

(58) Field of Classification Search ..... 40/299.01, 40/442, 444, 541, 441, 421, 540, 544, 581; 315/291, 307; 362/554, 800; 345/7; 235/7; 340/572.1, 12.5, 12.51, 13.24, 13.26
See application file for complete search history.

(56) References Cited

U.S. PATENT DOCUMENTS

| | | | | |
|---|---|---|---|---|
| 6,396,495 | B1 * | 5/2002 | Parghi et al. | 345/426 |
| 6,801,003 | B2 * | 10/2004 | Schanberger et al. | 315/291 |
| 6,964,370 | B1 * | 11/2005 | Hagale et al. | 235/380 |
| 7,022,960 | B2 * | 4/2006 | Yamamoto et al. | 250/205 |
| 7,113,196 | B2 * | 9/2006 | Kerr | 345/83 |
| 7,142,120 | B2 * | 11/2006 | Charych et al. | 340/572.4 |
| 7,329,998 | B2 * | 2/2008 | Jungwirth | 315/291 |
| 7,348,736 | B2 * | 3/2008 | Piepgras et al. | 315/291 |

(Continued)

FOREIGN PATENT DOCUMENTS

| | | | |
|---|---|---|---|
| JP | 2002305088 | A | 10/2002 |
| JP | 2005183050 | A | 7/2005 |
| WO | 2005107337 | A1 | 11/2005 |

(Continued)

OTHER PUBLICATIONS

Ito et al., Smart Furniture: Improvising Ubiquitous Hot-Spot Environment, 2006, Japan.

*Primary Examiner* — Minh D A
(74) *Attorney, Agent, or Firm* — Mark L. Beloborodov

(57) ABSTRACT

The invention relates to a data tag (6, 21, 32) storing at least one setting (13, 43) for controlling one or more lights (4, 18, 29). There is also provided a system and method for controlling a plurality of lights by receiving information (43) indicative of lighting settings for the plurality of lights (18, 29) from a data tag (21, 32) and controlling the plurality of lights (18, 29) in accordance with the lighting settings.

4 Claims, 7 Drawing Sheets

U.S. PATENT DOCUMENTS

| | | | | |
|---|---|---|---|---|
| 7,976,461 | B2 * | 7/2011 | Ertas et al. | 600/118 |
| 2005/0234778 | A1 * | 10/2005 | Sperduti et al. | 705/22 |
| 2005/0275626 | A1 * | 12/2005 | Mueller et al. | 345/156 |
| 2006/0066148 | A1 * | 3/2006 | Nguyen | 307/10.2 |
| 2006/0170376 | A1 | 8/2006 | Piepgras et al. | |
| 2006/0193133 | A1 * | 8/2006 | Von Der Brelie | 362/276 |

FOREIGN PATENT DOCUMENTS

| | | | |
|---|---|---|---|
| WO | 2006038135 | A1 | 4/2006 |
| WO | 2006081186 | A2 | 8/2006 |

* cited by examiner

LIGHTING CONTROL

This application is a national stage application under 35 U.S.C. §371 of International Application No. PCT/IB32007/053468 filed on Aug. 29, 2007, which claims priority to European Application No. 06120200.8, filed on Sep. 6, 2006, incorporated herein by reference.

The invention relates to lighting control, particularly but not exclusively to the use of radio frequency identification (RFID) tags for controlling lighting.

With technological advances in the field of lighting has come the ability to move away from the use of high-intensity light sources spreading light over a wide area, to 2 or 3 dimensional distributions of much smaller light sources, for instance light emitting diodes (LEDs), each lighting a limited target area, allowing the implementation of complex lighting effects.

The reduced size, low heat output and long life of LEDs in comparison to other light sources means that it becomes feasible to embed LEDs into items such as furniture. Advances in LED design have also led to the introduction of a broader range of adjustable parameters, such as illumination time, intensity, colour, directivity and dynamics, enabling LED technology to meet new demands in flexible and intelligent lighting control.

The use of atmospheric lighting and lighting for accenting objects has been common in certain environments such as restaurants and theatres, but is increasingly entering more diverse markets, such as the retail sector.

However, in spite of the advances in lighting technology and its increase in use, drawbacks remain. For instance, inherent complexities are encountered when attempting to control lighting. Often users setting up the lighting have neither the experience to configure the lighting optimally nor the time to configure the large number of settings available with modern lighting systems.

For instance, in shops, lighting can be used to enhance the look of certain products or to draw customers towards, or help customers to distinguish between, products or product ranges. However, such lighting effects can be complicated for staff to introduce, particularly those with little experience of dealing with lighting. This drawback, together with the large number of lights involved, can result in the implementation of new lighting arrangements taking a large amount of time. Furthermore, for chains of shops where coherent lighting may be required between different branches, it is not always desirable for local staff in each branch to have control of the lighting. This can be inefficient and is unlikely to result in the required lighting uniformity between branches.

The present invention aims to address these problems. According to the invention, there is provided a data tag storing at least one setting for controlling one or more lights.

By storing settings for controlling lights on a data tag, lighting control can be simplified. For instance, rather than lighting parameters such as colour, intensity or dynamic effects being entered manually by a user, such parameters can be automatically read from the data tag and immediately implemented when the data tag comes within range of a reading device.

The at least one setting can comprise at least one selected from the list of a colour setting for each of the one or more lights, an intensity setting defining the intensity of light to be produced by each of the one or more lights, a dynamic characteristics setting for the one or more lights, a light directivity setting defining a direction to which light produced by the one or more lights should be emitted, a selection of a subset of lights from a plurality of lights, a beam angle setting, a spot light setting, a diffuse light setting, an ambient light setting, and a combination of these settings. The at least one setting can also define a lighting effect, for instance controlling more than one parameter of the one or more lights so as to give a predetermined effect, for instance 'sun light'.

The data tag can comprise a radio frequency identification tag.

The data tag can be associated with an object and can store information relating to the object. For instance, movement of the object to within range of a data tag reader can trigger the lighting setting to be applied to the one or more lights. Also, the lighting setting can be tailored to the particular object, for instance in accordance with the object's colour.

The object can comprise an item of merchandise. Manufacturers and retailers are increasingly equipping products with RFID tags containing unique product identifiers. Such RFID tags can, according to the invention, be used to control lighting for the products in an intelligent manner. The information relating to the product can indicate a retail price for the object and, in this manner, lighting settings to be applied to the one or more lights can be selected in accordance with the price. The information can be indicative of the manufacturer and/or an identifier of the item of merchandise.

The data tag can comprise a security tag. For instance, the tag can be attached to a product in a shop and used for both the control of lighting in the shop as well as for preventing theft of the product from the shop when used in conjunction with a shop security system.

According to the invention, there is also provided a lighting controller comprising means for receiving data from a data tag, the data corresponding to at least one setting for a plurality of lights, and means for controlling each of the plurality of lights in accordance with the at least one setting to produce a lighting effect. The lighting effect can be produced by a lighting unit formed by the plurality of lights and/or other components. The plurality of lights can be a 3 dimensional arrangement of light sources and the other components can include the lighting controller.

The controlling means can comprise means for mapping the data to the at least one setting. Accordingly, the data need not be the setting itself, but can provide sufficient information for the setting to be determined by the controlling means.

The mapping means can further comprise means for accessing a database. In this way, settings can be stored on a database and, for instance, identified by the data on the tag. The contents of the database can, for instance, be updated, thus updating lighting settings to be applied to the plurality of lights without requiring reprogramming of the data tag.

The data can relate to a plurality of settings, wherein the receiving means is operable to receive further data from a further data tag, and wherein the controlling means is configured to select from the plurality of settings based on the further data. In this manner, if two or more data tags provide data to the receiving means, the lighting settings to be applied to the plurality of lights can be selected to as to apply a common setting to the lights.

The data can indicate the location of the settings stored in the database. The database can be connected to a local area network and/or to the internet.

The controlling means can comprise a lighting control interface for receiving the lighting instructions from the mapping means and for providing corresponding control signals for controlling the plurality of lights. The lighting control interface can operate according to the DMX, DALI, ZigBee, LON Works, Konnex or BACnet protocols.

The data can relate to an object with which the data tag is associated, for instance relating to a colour associated with the object. Defining the colour of the object on the data tag can enable the controlling means to determine a colour for the lights based on the colour of the object, without requiring the controlling means to consult a database to determine the colour of the object. The data can relate to a manufacturer or identifier of the object and settings can be mapped dependent on object's exposition time or popularity.

According to the invention, there is further provided a system comprising a plurality of lighting controllers according to the invention and a plurality of sets of lights, each set to be controlled independently by one of the lighting controllers.

The lighting controllers can be configured to communicate with each other. The plurality of lights can comprise light emitting diodes and/or can be mounted on an item of furniture, for instance for displaying items of merchandise in a shop. The receiving means can be configured to receive the data from only data tags located on or around the item of furniture.

The system can further comprise a data tag according to the invention.

According to the invention, there is further provided a method of controlling a plurality of lights, comprising receiving information indicative of lighting settings for the plurality of lights from a data tag and controlling the plurality of lights in accordance with the lighting settings to produce a lighting effect.

According to the invention, there is further provided a lighting control system for use in a retail environment, comprising a plurality of data tags, each to be associated with an item of merchandise and having stored thereon at least one lighting setting, a plurality of lights for illuminating the item of merchandise and a controller for receiving the at least one lighting setting from at least one of the data tags and for applying the lighting setting to the plurality of lights.

According to the invention, there is also provided a method of retail lighting comprising receiving data from a data tag associated with a product, the data indicative of a desired lighting effect, and controlling a plurality of lights to provide the lighting effect to the product.

According to the invention, there is also provided an item of merchandise including the data tag.

Embodiments of the invention will now be described, by way of example, with reference to the accompanying drawings in which.

Figure 5:
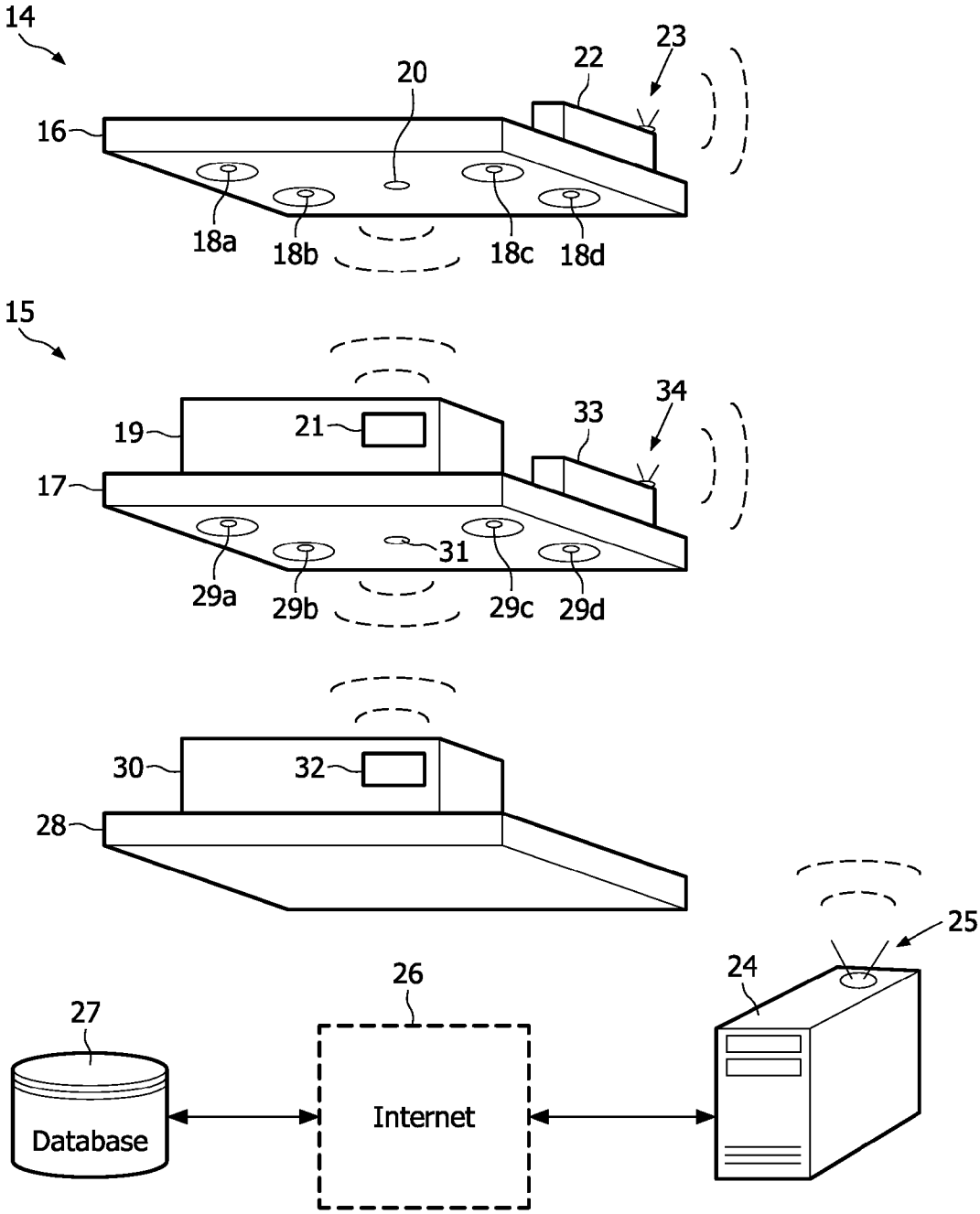
Figure 6:
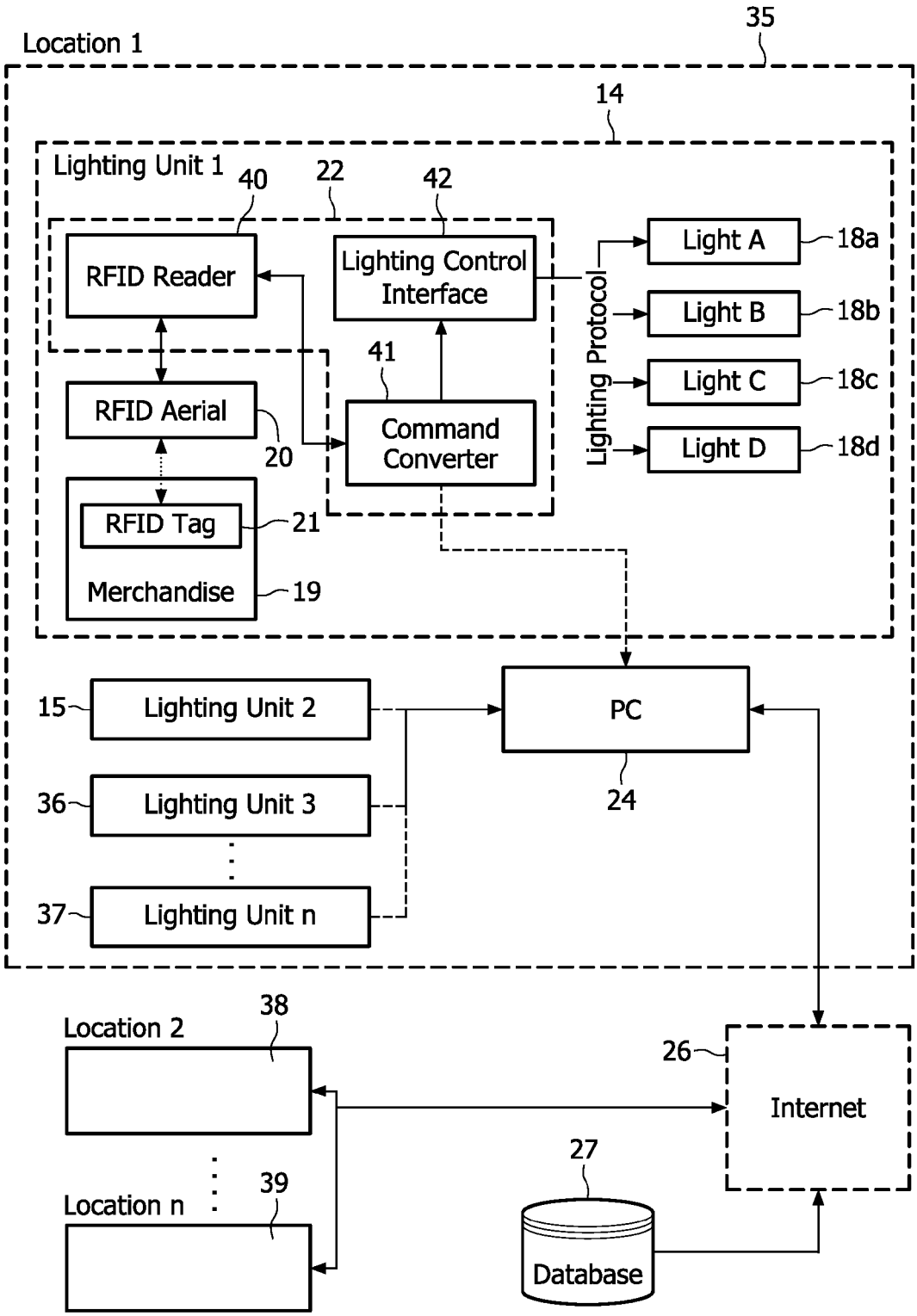
Figure 7:
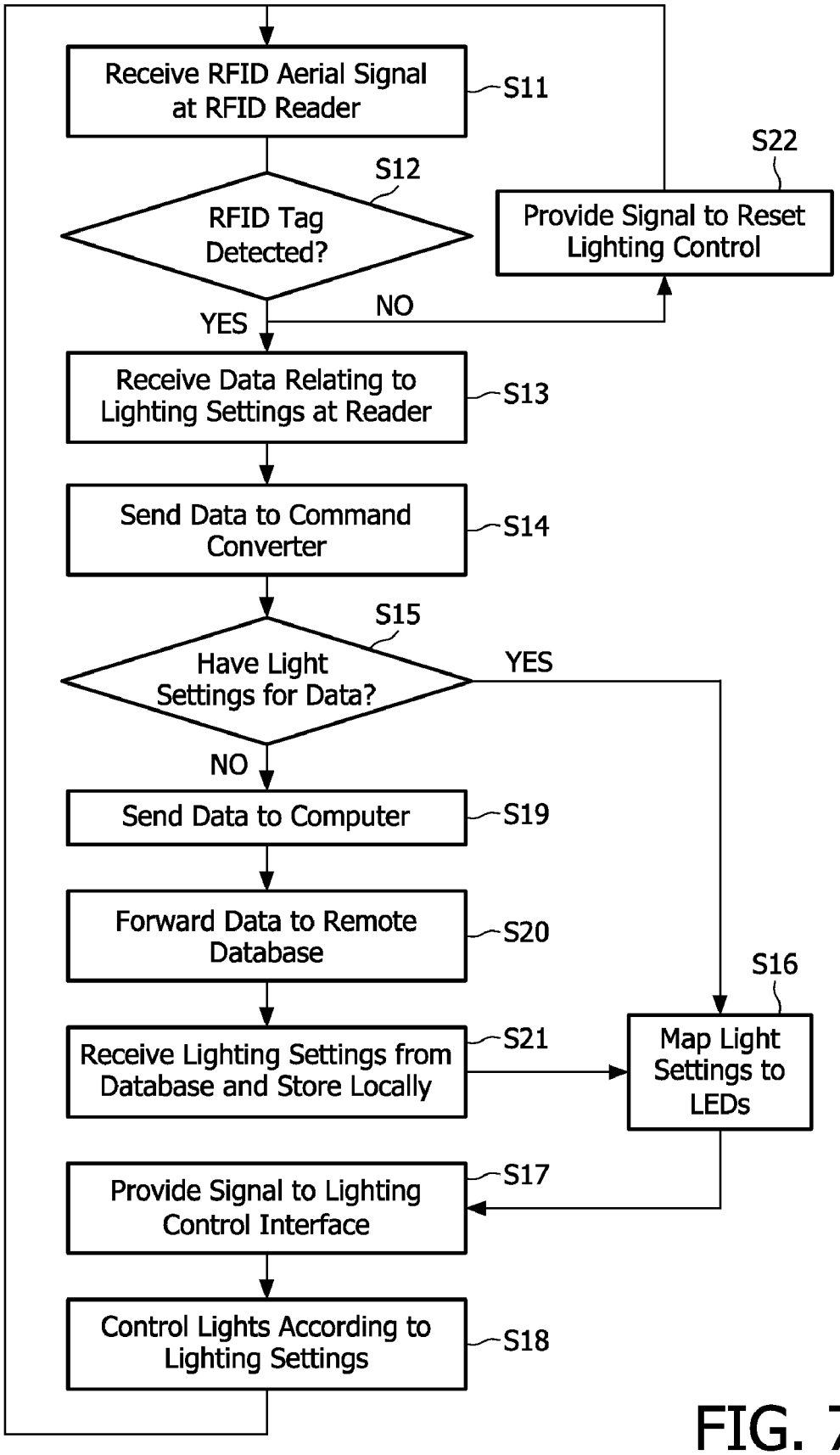
Figure 8A:
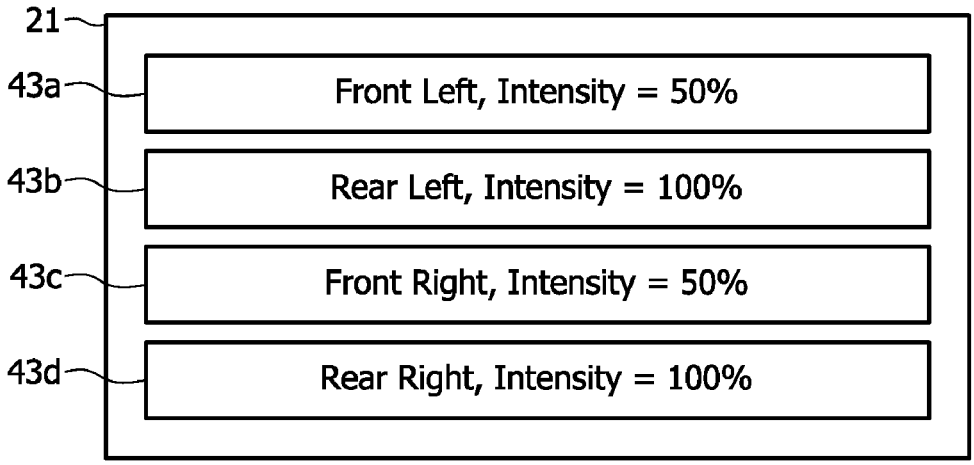
Figure 8B:
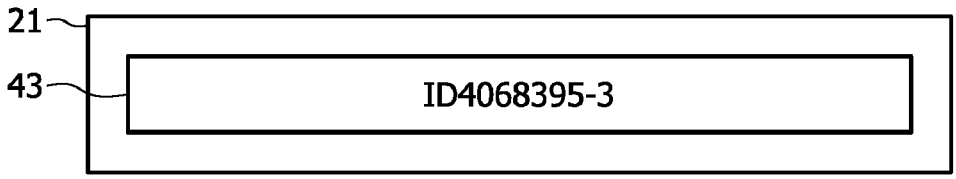
Figure 8C:
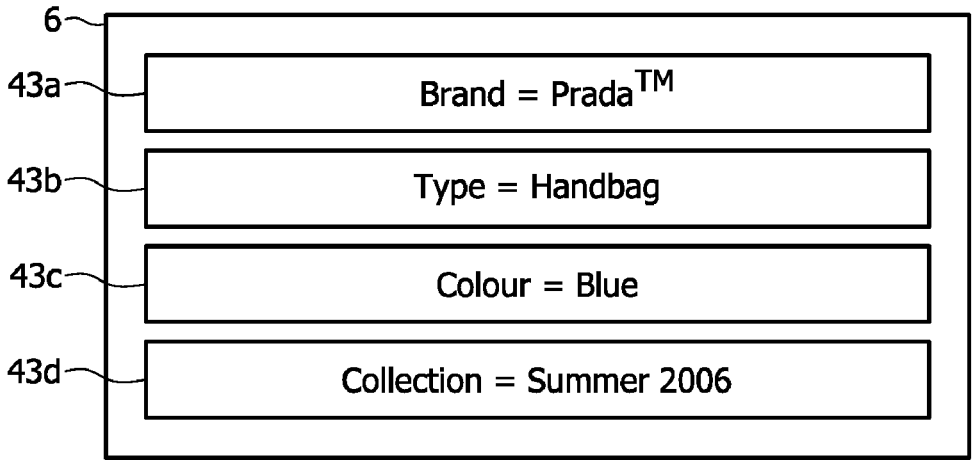

FIGS. 4*a* to 4*d* illustrate lighting settings stored on a data tag according to embodiments of the invention;

FIG. 5 is a perspective view of a shop lighting system according to a further embodiment of the invention;

FIG. 6 is a schematic illustration of a lighting system, including the shop lighting system of FIG. 5, according to a further embodiment of the invention;

FIG. 7 is a flow diagram illustrating the processing steps involved in controlling a plurality of lights according to an embodiment of the invention; and FIGS. 8*a*, 8*b* and 8*c* illustrate data stored on a data tag corresponding to lighting settings according to further embodiments of the invention.

Figure 1:
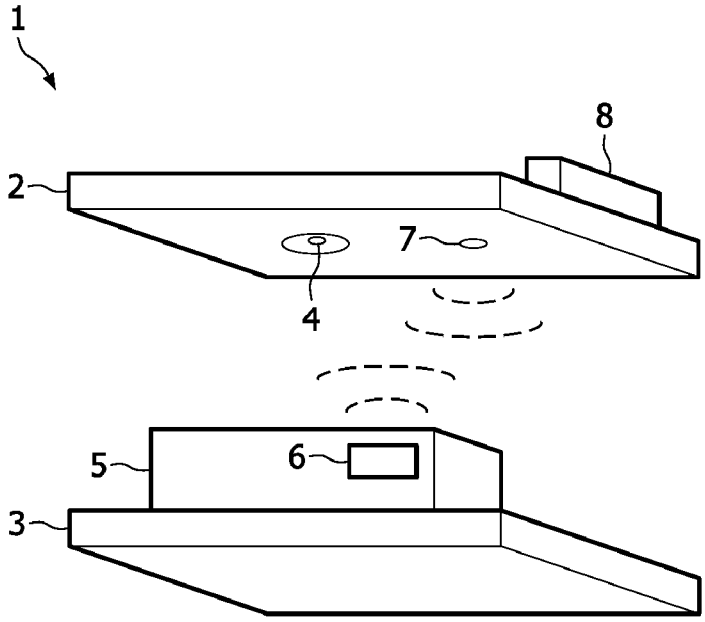
FIG. 1 is a perspective view of a lighting unit according to an embodiment of the invention.

Referring to FIG. 1, a lighting unit 1 according to an embodiment of the invention is arranged over upper and lower shelves 2, 3. The lighting unit 1 includes a light emitting diode (LED) 4 mounted on the upper shelf 2 such that it can illuminate an object 5, in this example an item of merchandise in a shop, placed on the lower shelf 3. Attached to the object 5 is a passive radio frequency identification (RFID) tag 6, detectable by an RFID aerial 7 mounted on the upper shelf 2. The lighting unit 1 further includes a control unit 8 mounted on the top surface of the upper shelf 2.

Figure 2:
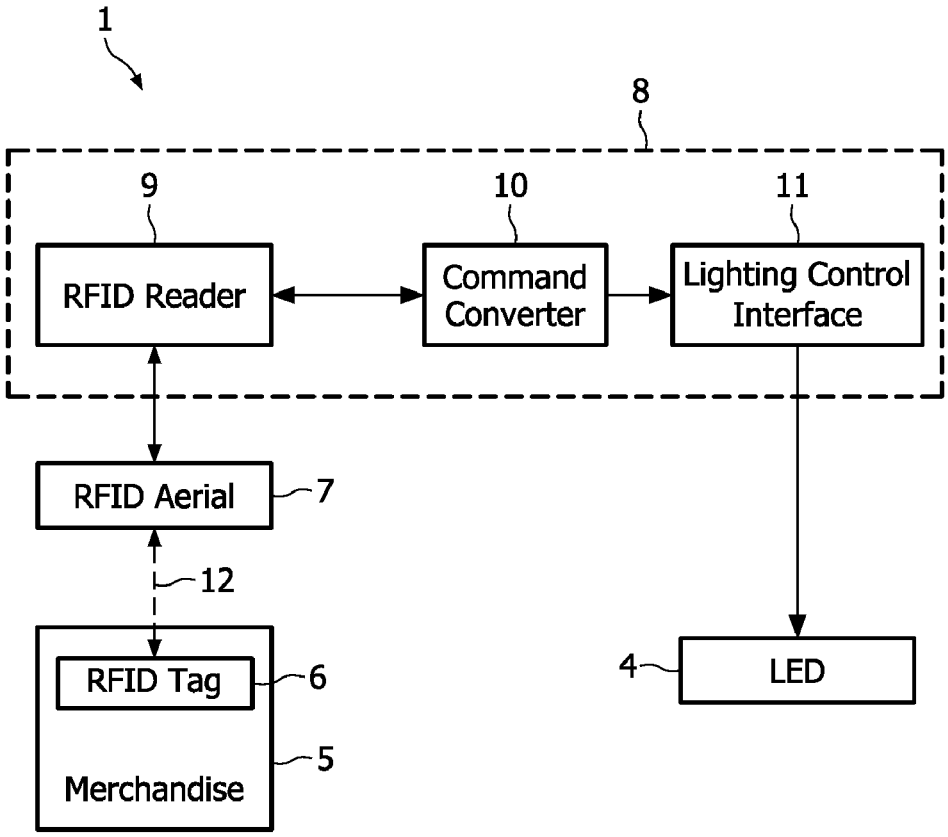
FIG. 2 is a schematic illustration of the lighting unit of FIG. 1.

FIG. 2 is a schematic illustration of the lighting unit 1 of FIG. 1. The RFID aerial 7 is connected to an RFID reader 9 within the control unit 8. Also within the control unit 8 is a command converter 10 and a lighting control interface 11, the command converter 10 being connected between the RFID reader 9 and the lighting control interface 11. The lighting control interface is, in turn, connected to the LED 4.

The command converter 10 includes an internal database (not shown) storing information about the light 4, its adjustable parameters and the current setting of each of the adjustable parameters.

In operation, the RFID aerial 7 outputs a radio frequency signal 12 (see FIG. 2) for reading one or more RFID tags 6 positioned within range of the RFID aerial 7. In the present example, the range of the RFID aerial 7 is substantially limited to the space between the upper and lower shelves 2, 3. The configuration and setup parameters of the aerial 7 and other equipment used for interrogating the RFID tag 6 are well known to those skilled in the art.

The processing steps performed by the control unit 8 in controlling the LED 4 will now be described with reference to FIG. 3.

A signal is received at the RFID reader 9 from the RFID aerial 7 (step S1) and, based on this signal, it is determined whether an RFID tag 6 is detected (step S2). The command converter 10 is, in the present example, configured to poll an output of the RFID reader 9 at regular intervals to determine whether an RFID tag 6 is detected, although other arrangements would be apparent to those skilled in the art. In the case that an object 5 having an RFID tag 6 is positioned on the lower shelf 3, the data contents of the RFID tag 6, in this example one or more lighting settings 13, are received by the RFID reader 9 (step S3) and passed on to the command converter 10 (step S4).

Figure 4A:
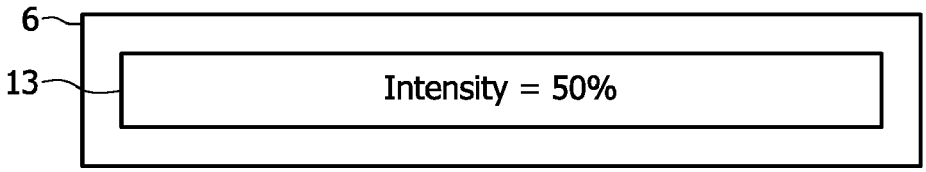
Figure 4B:
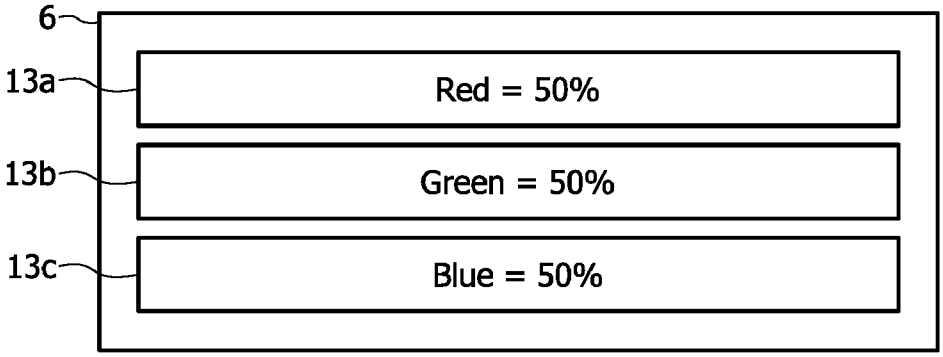

FIG. 4*a* illustrates a lighting setting 13, also referred to as a lighting instruction, stored on the RFID tag 6 according to an embodiment of the present invention. In this example, the LED 4 is a basic, monochromatic LED, for instance a 'white' light LED, and the setting 13 defines an intensity of light to be used to illuminate the object 5. Referring to FIG. 4*a*, the lighting setting 13 is specified as 'Intensity=50%', representing a light intensity of 50% of the maximum intensity of light that the LED 4 can produce.

Figure 3:
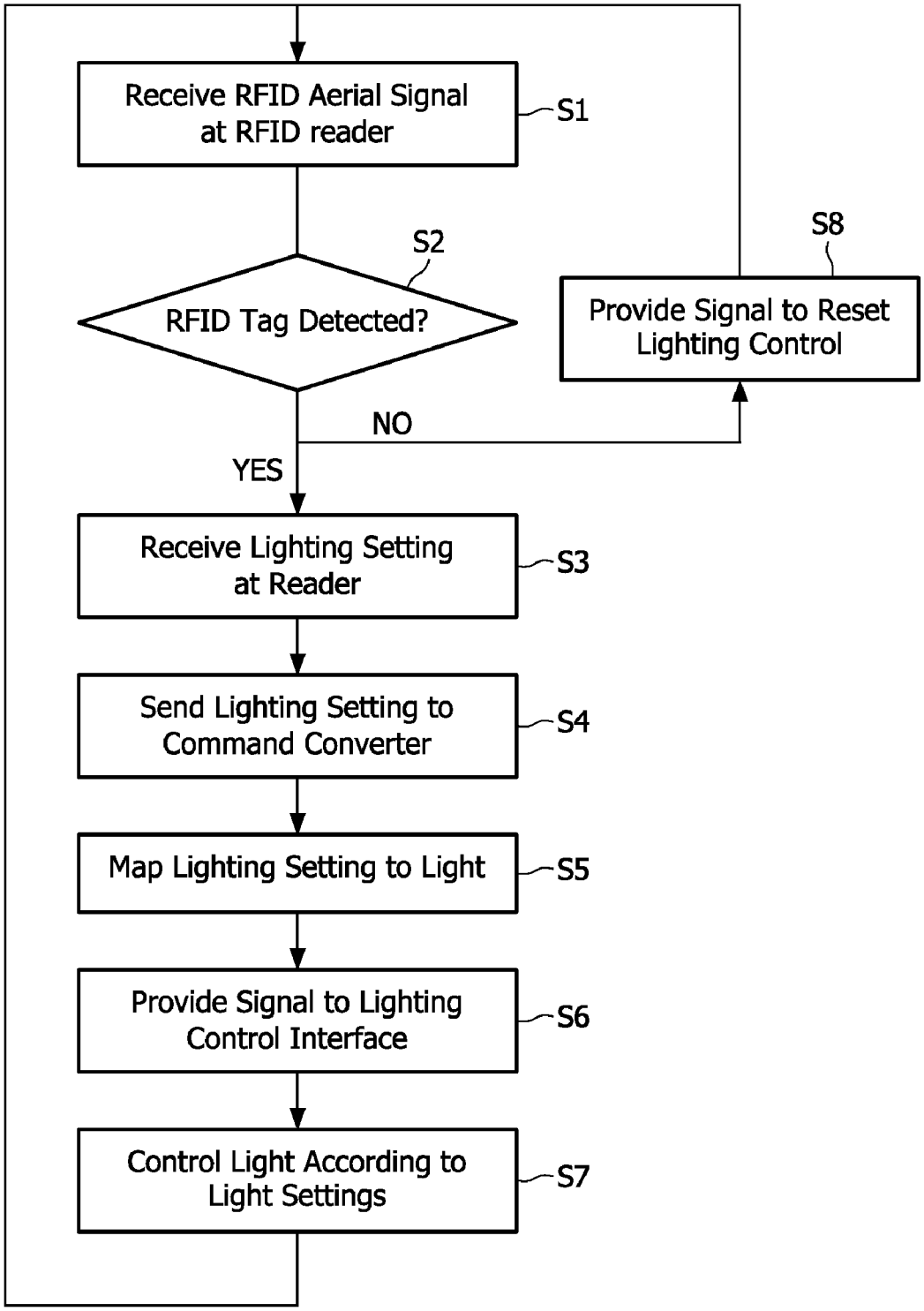
FIG. 3 is a flow diagram illustrating the processing steps involved in controlling a light according to an embodiment of the invention.

Referring to FIG. 3, upon receiving the lighting setting 13, the command converter 10 maps the setting 13 specified to its stored parameters for the light 4 (step S5). In the present example, the command converter 10 selects the intensity parameter it has stored for the light 4 and sends a signal corresponding to the required setting 13 for this parameter to the lighting control interface 11 (step S6), in a signal format compatible with the lighting control interface 11.

The lighting control interface 11, in the present example, operates according to the Digital MultipleX (DMX) lighting protocol. However, other wired or wireless control protocols may be used and would be known to those in the art, for instance the Digital Addressable Lighting Interface (DALI), 802.15.4/ZigBee, LON Works, Konnex, BACnet protocols or any other standard or proprietary control protocol known in the art, wired or wireless.

In response to the signal received from the command converter 10, the lighting control interface 11 controls the LED 4, in the present example by turning the LED 4 on at half its maximum light intensity (step S7).

If, at step S2, no RFID tags 6 are detected, a signal is provided from the RFID reader 9 to the command converter 10 indicating this. The command converter 10, in turn, determines the current status of the parameters of the LED 4 and, if a setting 13 has been applied, sends a signal to the lighting control interface 11 to set the parameters to a reset state (step S8). For instance, this could involve switching off the LED 4, or applying a standard setting such as an intensity of 100% or other predetermined value to the LED 4. Switching the LED 4 to the reset state can be performed immediately or can be performed in a dynamic fade operation, for instance uniformly or exponentially adjusting the parameters of the LED 4 from their previous value to the predetermined reset values.

Once the LED 4 has been reset, the command converter determines again, whether an RFID tag 6 is detected by the RFID reader 9 (step S2).

Whilst the lighting setting 13 of FIG. 4*a* has been described, the invention is not limited to data tags 6 storing lighting settings defining only the light intensity of the LED 4. The LED 4 can, in another example, be capable of producing light in a broad range of colours, for instance being formed of separate red, green and blue light emitting materials that can be controlled individually. In such circumstances, the light settings 13*a*-13*c* of FIG. 4*b* can, for instance, be used, specifying an overall lighting effect in which the intensity of each colour is defined individually.

Figure 4C:
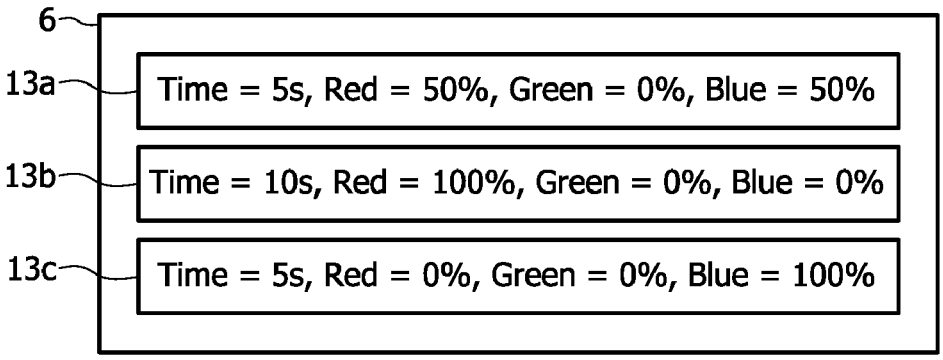

Alternatively, more complex light settings 13 are possible, for instance those depicted in FIG. 4*c*. As illustrated, intensities for each of the component colours red, green and blue of the LED 4 are specified for a predetermined time period. A first setting 13*a* of FIG. 4*c* defines the colour of the LED 4 in a first 5 second interval, such that red and blue are at 50% intensity and green is at 0% intensity. A second setting 13*b* defines the colour of the LED 4 in a second 10 second interval and a third setting 13*c* defines the colour of the LED 4 in a third 5 second interval. The LED 4 can, in this manner, be controlled to change colour repeatedly over a 20 second cycle while the data tag 6 of FIG. 4*c* is within range of the RFID aerial 7.

Figure 4D:
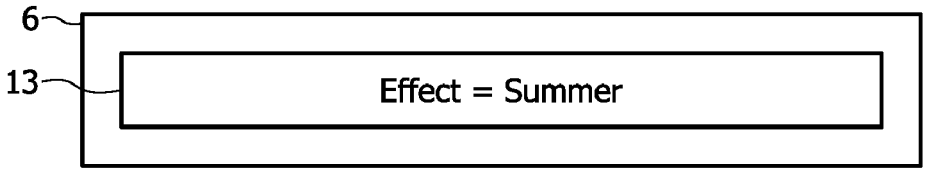

FIG. 4*d* illustrates a further setting in which a lighting characteristic or 'effect' is defined for the LED 4 by reference to a pre-stored setting, namely 'summer'. The command converter 10 can, in this example, be configured to consult a internal database of lighting 'effects' to determine the LED settings associated with the effect 'summer' and, in turn, to apply the determined LED settings to the LED 4 via the lighting control interface 11.

Other settings and parameters can also be used, for instance a setting specifying a colour temperature to define the colour required for the LED 4, rather than individual red, green and blue intensities. Also, a light directivity setting defining the direction to which light should be emitted, or effectively selecting a subset of lights, (for instance illumination from above, below, behind, left, and/or right), a beam angle setting, an illumination type setting (e.g. spot, diffuse, ambient light), or any other lamp setting known in the art.

Alternatively, the data stored on the data tag 6 need not be a lighting setting, but may provide information enabling the command controlled 10 to determine appropriate light settings. For instance, the data tag 6 can be arranged to store an identification number, which can be mapped to LED parameter settings by the command converter 10 by consulting an internal database of identification numbers and associated LED parameter settings. The data stored on the data tag can alternatively define the item of merchandise itself, and the command converter 10 can be configured to retrieve light settings that correspond to the particular item of merchandise 5 from a local or remote database. The data could define the colour of the item of merchandise 5 and the command converter 10 can be configured to 'match' the colour, or control the light 4 to emit a lighter or darker or opposite colour to that of the item of merchandise 5. The data could define the price of the item of merchandise 5 and the command converter 10 could be configured to control the light 4 to emit a colour defined for the price of the items of merchandise 5.

The data tag 6 can be configured to store any combination of the above settings and data. Furthermore, the data tag 6 can be arranged to store multiple settings, such that when multiple data tags 6 are detected by the RFID reader 9, a common setting from among the multiple settings stored on the data tags 6 can be found.

Although a single LED 4 is described, the controller 8 can alternatively be arranged to control a plurality of light sources.

The invention enables the light setting applied to the LED 4, or other light sources, to be selected according to the item of merchandise 5 to which the data tag 6 is applied. For instance, the setting 13 can define colours, intensities and/or dynamics which match or contrast to those of the item of merchandise 5 to accentuate it.

FIG. 5 illustrates a shop lighting system including first and second lighting units 14, 15 according to a further embodiment of the invention. The first lighting unit 14 is arranged over first and second shelves 16, 17, the first shelf 16 being directly above the second shelf 17, and comprises a first set of four LEDs 18*a*-18*d* mounted on the first shelf 16. The first set of LEDs 18*a*-18*d* is arranged to illuminate a first object 19, in this case an item of merchandise in the shop. The first lighting unit 14 also includes a first RFID aerial 20 for sending and receiving signals for detecting and reading a first passive RFID tag 21 attached to the first object 19, as well as a first control unit 22. The first control unit 22 is equipped with a first wireless network transceiver 23 for communicating with a computer 24 via a wireless network transceiver 25 connected to the computer 24. The computer 24 is connected to the internet 26 and, over this connection, can access a remote database 27.

The second lighting unit 15 is arranged over the second shelf 17 and a third shelf 28, the third shelf 28 being disposed directly beneath the second shelf 17. The second lighting unit 15 comprises a second set of four LEDs 29*a*-29*d*, mounted on the second shelf 17. The second set of LEDs 29*a*-29*d* is arranged to illuminate a second object 30, in this case, like the first object 19, an item of merchandise in the shop. The second lighting unit 15 also includes a second RFID aerial 31 for sending and receiving signals for detecting and reading a second passive RFID tag 32 attached to the second object 30, as well as a second control unit 33. The second control unit 33 is equipped with a second wireless network transceiver 34 for communicating with the computer 24.

FIG. 6 schematically illustrates a system for controlling lighting in a number of remote locations, the system including the shop lighting system of FIG. 5.

Referring to FIG. 6, a first lighting system 35 at a first location, in this case the shop lighting system of FIG. 5, includes the first and second lighting units 14, 15, as well as a third lighting unit 36 and an nth lighting unit 37. Each lighting unit 14, 15, 36, 37 may be substantially the same, or include different ranges of lights or be arranged over or around, or be associated with different items of furniture, for instance cabinets, racks, tables, fitting rooms, mannequins and so on. Each lighting unit 14, 15, 36, 37 includes a command converter connected to the computer 24 via a wireless network, which is in turn connected to the remote database 27 via the internet 26.

Also connected to the remote database 27 via an internet connection are second and nth lighting systems 38, 39 installed at respective second and nth locations. The may each be similar to the first lighting system and include a plurality of lighting units, each connected to a computer via a wireless network.

As illustrated, in the first lighting system, the first RFID aerial 20 of the first lighting unit 14 is connected to an RFID reader 40 within the first control unit 22. Also within the first control unit 22 is a command converter 41, connected to the RFID reader 40, and a lighting control interface 42 connected between the command converter 41 and the first set of LEDs 18*a*-18*d*.

The command converter 41 includes first and second internal databases (not shown). The first stores information about the lights 18*a*-18*d*, such as their positions, their adjustable parameters and the current state of each of the adjustable parameters. The second database stores information for mapping data contents of RFID tags to lighting settings, as will be described in more detail below.

FIG. 7 is a flow diagram illustrating the processing steps involved in controlling the lights 18*a*-18*d* of the shop lighting system of FIG. 5 according to an embodiment of the invention.

Referring to FIG. 7, a signal is received at the first RFID reader 40 from the RFID aerial 20 (step S11) and, based on this signal, it is determined whether an RFID tag 21 is detected (step S12). In the case that an object 19 having an RFID tag 21 is positioned on the second shelf 17, the data contents of the RFID tag 21, namely data relating to lighting settings, are received by the RFID reader 40 (step S13) and passed on to the command converter 41 (step S14).

The command converter 10 determines whether it has light settings for the received data (step S15) by consulting its second internal database.

FIG. 8*a* illustrates an example of the data relating to lighting settings 43 stored on the RFID tag 21 according to an embodiment of the invention. Referring to FIG. 8*a*, four separate lighting settings 43*a*-43*d* are provided, these respectively relating to lighting positions of 'front left', 'rear left', 'front right' and 'rear right' and each has an associated light intensity. In this example, the data in fact relates to light settings themselves and therefore the command converter 10 consults its first internal database defining parameters of the LEDs 18*a*-18*d* and, from this, maps the position information associated with each LED 18*a*-18*d* with each respective lighting position of the lighting settings 43*a*-43*d* (step 16).

The command converter 10 then provides a signal to the lighting control interface 42 for controlling the LEDs 18*a*-18*d* in accordance with the mapped settings (step S17). The lighting control interface 42 provides a signal to control the LEDs 18*a*-18*d* accordingly, in the present example by turning the front left LED 18*a* on at half its maximum light intensity, the rear left 18*b* at full intensity, the front right 18*c* at half intensity and the rear right at full intensity (step S18).

FIG. 8*b* illustrates a further example of data 43 stored on the RFID tag 21. In this example, the data 43 defines an identification number, 'ID4068395-3', relating to the object 19, in this example an item of merchandise. The second internal database of the command converter 41 stores identification numbers and corresponding lighting settings and therefore the command converter 41 consults this database to determine whether the number ID4068395-3 is listed. In the case that it is listed, the command converter 41 determines that it has light settings for the data stored on the RFID tag 21 and therefore proceeds to map the settings to the LEDs 18*a*-18*d* and to provide a signal to the lighting control interface 42 to control the LEDs 18*a*-18*d* as previously described (steps S17-S18).

If, however, the identification number of the object 19 is not listed in the second internal database, the command converter 41 does not have the required lighting settings for the data 43 (step S15) and so sends the data received from the RFID reader 40, via the first transceiver 23, to the computer 24 (step S19). The computer 24, in turn, forwards the data 43 to the remote database 27, via the internet 26 (step S20). The remote database 27 stores a list of centrally updated identification numbers together with corresponding lighting settings and, in response to receiving the identification number 43, returns the lighting settings stored for that identification number to the command converter 41 via the computer 24, which are received by the command converter 41 (step S21). Once received, the command converter 41 stores the settings in the second internal database and maps the light settings to the LEDs 18*a*-18*d* (step S16). The command converter then provides a signal to the lighting control interface 42 to control the LEDs 18*a*-18*d* accordingly (steps S17 and S18).

If, at step S12, no RFID tags 21 are detected, a signal is provided from the RFID reader 40 to the command converter 41 indicating this. The command converter 41, in turn, determines the current status of the parameters of the LEDs 18*a*-18*d* and, if a setting has been applied, sends a signal to the lighting control interface 42 to set the parameters to a reset state (step S22). For instance, this could involve switching off the LEDs 18*a*-18*d*, or applying a standard setting such as an intensity of 100% or other predetermined value to each of the LEDs 18*a*-18*d*. Switching the LEDs 18*a*-18*d* to the reset state can be performed immediately or can be performed in a dynamic fade operation, for instance uniformly or exponentially adjusting the parameters of the LEDs 18*a*-18*d* from their previous value to the predetermined reset values.

FIG. 8*c* illustrates another example of data 43*a*-43*d* stored on the RFID tag 21. In this example, the data 43 defines the brand 43*a*, type 43*b*, colour 43*c* and collection 43*d* of the item of merchandise 19. The second internal database of the command converter 41 stores lighting settings corresponding to this data relating to the item of merchandise and therefore the command converter 41 consults this database to determine whether this data is listed, and performs steps S16 or S19-S21 accordingly. For instance, the second internal database may indicate that all 'Prada™' goods should have a particular light setting, or contain light settings for items that match the definition 'blue' and 'handbag', or any other combination of some or all of the data 43*a*-43*d*.

The lighting control interface 42, in the present example, operates according to the Digital MultipleX (DMX) lighting protocol. However, as previously mentioned, other lighting protocols may be used and would be known to those in the art.

Accordingly, the invention provides a means by which light sources can be controlled based on lighting settings stored on a remote database. The light settings can, accordingly, be amended and updated when required and such changes can automatically filter through to the lighting systems installed at a variety of remote locations. For instance, light settings dependent on product information can be updated centrally when a new product range is launched, and these settings can be automatically sent out to the lighting systems of a plurality of shops, for instance via the control units of each lighting unit.

As described, the light settings applied to the lighting units of the invention can be determined by the product to which an RFID tag is attached. This enables a new, broad range of lighting possibilities for use in the retail environment. For instance, lighting settings can be applied according to product type (for instance different colour themes for shoes compared to hats in a clothing store), product class (for instance applying coloured light to expensive products and white light for products on special offer), product price or product collection or style, or any combination of these product classifications. Such information can be stored on the data tags, either by shop staff or during manufacture, such that it can be available for interpretation by the command converters, or can alternatively be held on the remote or other such databases.

Further possibilities exist, for instance adjusting lighting settings according to the time a given product has spent on a shelf. This can, for instance, be based on the total time the product has been in the shop or the time that a product has been on a particular item of furniture, such that shoppers can determine products which have newly arrived or can be attracted, via eye catching lighting effects, to products that have been on the shelf for a long time. Alternatively, the lighting settings can be dependent on the number of times a given product is removed from the shop furniture so indicate that products moved temporarily from the furniture a large number of times are in high demand and therefore the 'most wanted' products.

The command converters can be configured to communicate with each other such that lighting settings between the command converters can be harmonised and such that the detection of an RFID tag by one RFID reader can result in multiple light changes in neighbouring lighting units. A single command converter and/or lighting control interface can be used to control a plurality of lighting units. In particular, the lighting units themselves need only comprise a data tag reader and means for communicating data relating to detected data tags to a shared controller including a shared command converted and lighting control interface capable of controlling a plurality of sets of lights. In this manner, the shared controller can be used to control a particular rack of goods in a shop, or even the lighting for the entire shop. The shared controller may be implemented by one or more programs stored on the computer 24.

From reading the present disclosure, other variations and modifications will be apparent to persons skilled in the art. Such variations and modifications may involve equivalent and other features which are already known in the design, manufacture and use of lights and light control systems and which may be used instead of or in addition to features already described herein.

Although claims have been formulated in this application to particular combinations of features, it should be understood that the scope of the disclosure of the present invention also includes any novel features or any novel combination of features disclosed herein either explicitly or implicitly or any generalisation thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further applications derived therefrom.

For example, the embodiments described use the approach of the invention for controlling LEDs, however, the invention is not limited to controlling LEDs but could be applied to control of other light sources such as fluorescent or incandescent lights, halogen lamps, or any other types of light sources known in the art which, alone or in groups, have at least one lighting parameter that can be controlled. Furthermore, embodiments have been described for controlling shop lighting, although the invention can also be applied to other internal lighting or external lighting, for instance for exhibitions, city beautification and the like.

Although specific methods of operation have been described, these may be adapted to add or remove steps and/or to perform the steps in a different sequence without departing from the principles of the present invention.

Although the command converters of the lighting controllers have been described as communicating using a wireless network, for instance a wireless local area network (WLAN) operating according to the 802.11 standard, other wired or wireless backbone communication systems are possible, for instance Ethernet or ZigBee (802.15.4).

The contents of the first and/or second internal databases of the command converter 41 can alternatively or additionally be stored at other locations such as within memory of the computer 24 or in the remote database 27. Although passive RFID data tags have been described, the invention is not limited to such tags. Other contactless, also referred to as wireless data tags can be used, either being active or passive, for instance those operating according to short-range active or preferably passive data access technologies or near field communication (NFC) standards, for instance infrared communications. The readers 9, 40, can be configured to be capable of reading a variety of data tag formats and standards.

The invention claimed is:

1. A lighting unit comprising:

a data tag reader linked to a command converter and a lighting control interface, the lighting control interface connected to a set of LEDs, the command converter wirelessly linked to a computer system, the computer system linked to a remote database residing via an internet connection;

a first database residing in the command converter and storing information about the set of LEDs;

a second database residing in the command converter and storing information for mapping data contents of data tags to lighting settings; and the data tag reader configured to detect data contained in a data tag and transmit the data to the command converter, the command converter searching the first and second databases upon receipt of the data and generating a lighting setting signal to the lighting control interface for controlling the set of LEDS in accordance with the information in the first database and the mapped settings in the second database, wherein the computer system provides updated data from the remote database to the second database, wherein the data tag is a radio-frequency identification(RFID) tag and the data tag reader is a RFID reader.

2. The lighting system of claim 1 wherein the information for mapping data contents of data tags to lighting settings is selected from the group consisting of product type, product class product price, product collection, product style, time a given product has spent on a shelf, and number of times a product is moved.

3. The lighting system of claim 1 wherein the lighting control interface operates according to a DMX, DALI, ZigBee, LON works, Konnex or BACnet protocol.

4. The lighting system of claim 1 wherein the data in the data tag comprises lighting settings selected from the group consisting of a color lighting setting, an intensity lighting setting defining an intensity of light to be produced, a light directivity lighting setting defining a direction to which light produced should be emitted, a selection of a subset of lights lighting setting from a plurality of lights, a beam angle lighting setting, a spot light lighting setting, a diffuse light lighting setting, an ambient light lighting setting, and a dynamic characteristics lighting setting for the one or more lights.

* * * * *